United States Patent [19]

Berkelder

[11] Patent Number: 4,831,999

[45] Date of Patent: May 23, 1989

[54] COOKING AND BAKING DEVICE TO BE BUILT IN

[75] Inventor: Wilhelm H. Berkelder, CD Aalten, Netherlands

[73] Assignee: Apparatenfabrick ATAG B.V., Ulft, Netherlands

[21] Appl. No.: 629,544

[22] PCT Filed: Nov. 2, 1983

[86] PCT No.: PCT/NL83/00045

§ 371 Date: Jun. 28, 1984

§ 102(e) Date: Jun. 28, 1984

[30] Foreign Application Priority Data

Nov. 2, 1982 [NL] Netherlands ..... 8204247

[51] Int. Cl.[4] ..... A21B 1/00

[52] U.S. Cl. ..... 126/19 R; 126/273 R; 126/39 N; 219/480; 219/446

[58] Field of Search ..... 126/273 R, 273 A, 19 R, 126/39 N, 39 J, 39 K; 219/445, 448, 464, 477, 480, 446; D7/340, 346, 348, 349, 350

[56] References Cited

U.S. PATENT DOCUMENTS 2,237,795 4/1941 Shroyer ..... 219/460
2,539,840 1/1951 Jones .
2,897,812 8/1959 Albrecht ..... 126/273 A
3,257,543 6/1966 Regan et al. ..... 219/476
3,859,499 1/1975 Evans et al. ..... 219/464

*Primary Examiner*—Carroll B. Dority, Jr.
*Attorney, Agent, or Firm*—Birch, Stewart, Kolasch & Birch

[57] ABSTRACT

A cooking and baking device to be built in comprising an oven and a cooktop, the oven comprising: a frame, a cabinet-shaped oven unit connected with the frame and provided with a hinged door and an oven control-member connected with the frame and carrying at least one oven actuating member partly protruding from a control-panel connected with the frame, and the cooktop comprising a cooktop unit adapted to be built in a horizontal plane and cooktop control-members connected with cooktop actuating members partly protruding from the control-panel. The cooktop control-members are functionally and permanently connected with the cooktop unit and the cooktop comprises an actuating unit releasably connected with the frame, in which at least the cooktop actuating members are arranged. Preferably at least the visible part of the control-panel is a releasable front panel with recesses for the actuating members.

6 Claims, 1 Drawing Sheet

FIG.1
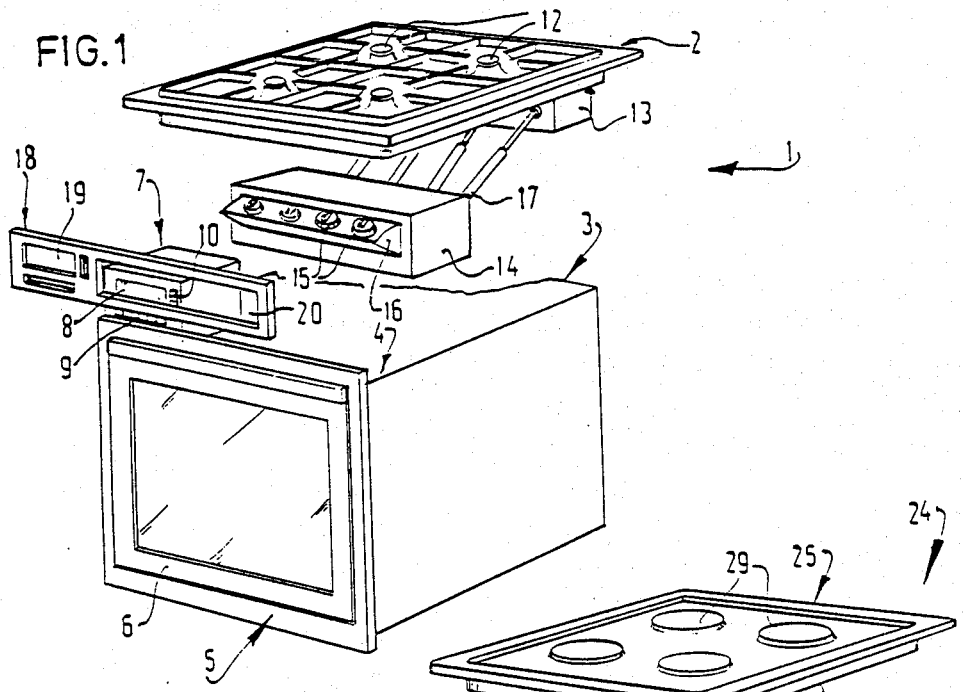
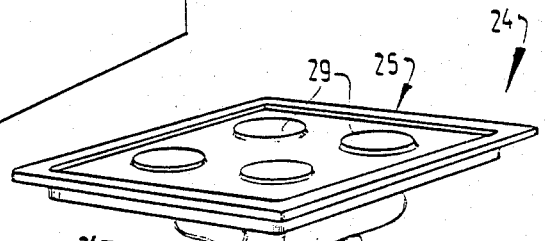
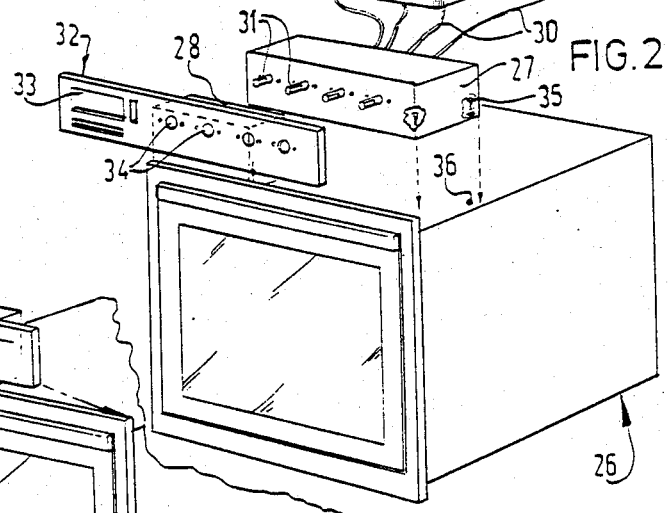
FIG.2
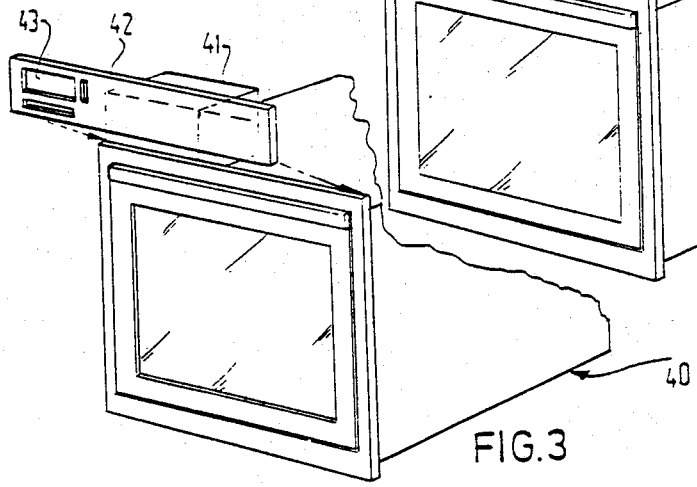
FIG.3

COOKING AND BAKING DEVICE TO BE BUILT IN

BACKGROUND OF THE INVENTION

1. Field of the Invention

The invention relates to a cooking and baking device to be built in comprising an oven and a cooktop, said oven comprising a frame, a cabinet-shaped oven unit connected with said frame and provided with a pivotable door and an oven control-member connected with said frame and carrying an oven actuating member partly protruding beyond a control panel connected with the frame, whilst the cooktop comprises a cooktop unit to be built in in a horizontal plate and cooktop control-members which are connected with cooktop actuating members partly protruding beyond the control panel.

2. Description of the Prior Art

Such a device is generally known and was developed on the basis of the separate kitchen range when it was desired to provide closed, continuous kitchen furniture featuring built-in appliances. The supporting function of the kitchen range housing is taken over by the kitchen furniture in the built-in devices. It is common practice in a device of the kind set forth, in which the cooktop is operating with electric heating elements, to rigidly secure the control-members for the cooktop together with the control-members for the oven to the oven. When building in, the electric conductors of the cooktop are connected to the oven.

With the increasing diversity of types of cooking-/baking devices the costs involved in having all these types in stock rise explosively.

SUMMARY OF THE INVENTION

The object of the invention is to provide a cooking-/baking device of the kind set forth in the preamble, by which with a limited stock a great diversity of types of such devices can nevertheless be supplied.

In a cooking/baking device according to the invention this is achieved in that the cooktop control-members are permanently and functionally connected with the cooktop unit and the cooktop comprises an actuating unit releasably connected with the frame, which unit accommodates at least the cooktop actuating members. Thus the cooktop and the oven constitute independent parts which are combined in accordance with the desired type of cooking/baking device.

In one embodiment of the device in accordance with the invention the cooktop is an electric cooktop and the cooktop control-members are housed in the actuating unit and permanently connected by electric conductors to the cooktop unit. Owing to the flexible nature of the electric conductors the actuating unit can be simply mounted on the frame.

In a further device according to the invention the cooktop is a gas cooktop and the cooktop control unit is rigidly secured to the cooktop unit and through rod transmissions connected with the cooktop actuating members in the actuating unit.

An additional advantage of the invention is that both the cooktop and the oven can be separately tested, since the actuating members of each unit are connected with said unit. This is contrary to the prior art in which the cooking/baking device as a whole need be tested.

According to a particularly advantageous aspect of the invention at least the visible part of the control-panel is formed by a releasable front panel with recesses for the actuating members. Owing to this front panel the parts become a unit also visually. By using this separate front panel it is also possible to adapt the device according to the invention in a simple manner to the colour of the kitchen furniture. Only the front panel need be of the colour concerned.

The invention relates to and provides furthermore a cooktop for use in a device according to the invention. This cooktop comprises a cooktop unit, a cooktop control unit and cooktop actuating members connected with said control unit. According to the invention the cooktop control unit are functionally, permanently connected with the cooktop unit, whilst at least the cooktop actuating members are housed in an actuating unit provided with fastening means for a releasable connection with the frame.

The invention furthermore relates to and provides an oven comprising a frame, a cabinet-shaped oven unit connected with said frame and provided with a hinged door and an oven control-member connected with said frame and carrying an oven actuating member partly protruding beyond a control-panel connected with the frame. According to the invention the oven comprises first fastening means for fastening a control-unit to the frame of a cooktop and second fastening means for fastening a detachable front panel of a control-panel. The oven can thus be used in conjunction with a cooktop according to the invention to obtain a cooking/baking device in accordance with the invention. For this purpose the control-unit of the cooktop is secured by the first fastening means to the frame. Subsequently a front panel matching the desired type is provided for the control-members. The oven according to the invention may, however, also be used as a separate oven at eye level. Then a front panel is used which only has recesses for the control-members of the oven itself. The remaining part of the front panel is closed.

BRIEF DESCRIPTION OF THE DRAWINGS

The invention will be described more fully hereinafter with reference to schematically shown embodiments of the invention.

FIG. 1 is a schematic, perspective exploded view of a first embodiment of the cooking/baking device in accordance with the invention.

FIG. 2 is a view corresponding to FIG. 1 of a second embodiment.

FIG. 3 is a schematic, perspective view of an oven according to the invention.

DETAILED DESCRIPTION OF THE DRAWINGS

The cooking/baking device 1 comprises an oven housing 3 and a cooktop housing 2. The oven housing or unit 3 comprises a frame 4 and a cabinet-shaped oven unit 5 connected with the frame 4. The oven unit 5 is provided with a hinged door 6. On the oven unit is placed a cabinet 7, which accommodates the oven control-member (not shown in detail). This oven control-member is connected with actuating members formed by push-buttons 9. The cabinet 7 furthermore comprises a time switch, the indications of which are visible behind a window 8. The time switch has control-members 10.

The cooktop unit 2 is a gas cooktop having, in this case, four burners 12. The burners 12 are connected through control unit 13 with a gas supply duct. The control unit 13 is actuated by actuating unit 14, the control-knobs 15 of which are shown in FIG. 1. In this embodiment of the device in accordance with the invention the control-knobs are arranged on a tiltable panel 16. According to the invention the actuating unit 14 can be connected with the frame 4 of the oven housing 3. The cooktop control unit 13 is rigidly connected with the cooktop unit. The actuating unit 14 comprises in this embodiment of the invention only the actuating members and may, therefore, be releasably connected with the frame 4. The rod transmissions 17 may comprise a sliding piece and universal joints so that the position of the actuating unit 14 can be varied to a limited extent with respect to the control unit 13. The device 1 furthermore comprises a front panel 18, which can be placed in front of the control-panel formed by the cabinet 7 and the actuating unit 14. The front panel 18 has openings 19 for the actuating members of the oven and an opening 20 for the actuating members of the cooktop. In the built-in state, in which the actuating unit 14 is connected with the frame 4, the front panel 18 suggests that the oven actuating members and the cooktop actuating members constitute a single unit. The front panel 18 may be designed in a colour matching the colour of the kitchen furniture.

The device 24 of FIG. 2 comprises a cooktop unit 25 with electric heating elements 29. The oven 26 again comprises a cabinet 28 receiving the actuating members and the control-members of the oven. The actuating members and the control-members of the cooktop 25 are together housed in the actuating unit 27. The cooktop control-members are functionally, permanently connected with the cooktop unit through the electric conductors 30. The actuating unit 27 with the parts 31 of the actuating members of the cooktop protruding out of said unit can be releasably connected with the frame of the oven by means of bolts 35 engaging bolt holes 36 in the oven frame 24. However, the cooktop may also be used separately. In particular the cooktop 25 can be separately tested, since the actuating unit 27 with the control-members and the actuating members is integral with the cooktop. The device 24 furthermore comprises a front panel 32 having recesses 33 and 34 for the actuating members of the oven and the actuating members of the cooktop.

FIG. 3 partly shows an oven housing 40 embodying the invention. On this oven housing 40 is arranged a cabinet 41 accommodating the actuating and control-members of the oven in the manner described above. The oven housing furthermore comprises first fastening means such as the bolt holes 36 of FIG. 2 for fastening an actuating unit to the frame. The oven embodying the invention furthermore comprises fastening means for the releasable front panel.

The oven housing 40 shown in FIG. 3 in conjunction with the front panel 42 is also suitable for use as a separate, so-called eye-level oven. The panel 42 only has recesses 43 for the actuating members of the oven. The remaining part of the panel is closed.

By the cooking/baking device according to the invention a number of desired types can be assembled in a very effective manner from separate parts such as the oven unit, the cooktop unit and the front panel. In this way costs of stock are appreciably reduced.

Furthermore the cooking/baking device according to the invention has the advantage that the cooktop housing as well as the oven housing can be separately tested.

By using the separate front panel every type can be supplied in a simple manner in a colour matching that of the kitchen. The oven door may then be provided with a front panel in the same colour.

I claim:

1. A cooking and baking device to be built in comprising an oven and a cooktop, said oven comprising:

a frame, a cabinet-shaped oven unit connected with said frame, a door hinged to said cabinet-shaped oven unit, a cabinet containing an oven control member connected with said frame, oven actuating members extending from said cabinet and connected with said oven control member, a front panel having openings therein connected to said frame, said oven actuating members extending through a portion of said openings in said front panel, said cooktop comprising a cooktop unit, an actuating unit connected with said frame, said cooktop unit including heating means for cooking purposes, said actuating unit being connected to said heating means through connecting means, control members connected to said actuating unit in order to regulate said heating means, and said control members extending through another portion of said openings in said front panel.

2. A device as claimed in claim 1 characterized in that said cooktop is an electric cooktop and in that said connecting means are electric conductors.

3. A device as claimed in claim 1 characterized in that said cooktop is a gas cooktop and in that said connecting means includes a control unit rigidly fastened to the cooktop unit and linked through rod transmissions to the actuating unit.

4. A device as claimed in claim 1 characterized in that at least the visible part of said front panel is a releasable panel having said openings.

5. A device as claimed in claim 2, wherein at least the visible part of said front panel is a releasable panel having said openings.

6. A device as claimed in claim 3, wherein at least the visible part of said front panel is a releasable panel having said openings.

* * * * *